US011732442B2

(12) United States Patent
Wu et al.

(10) Patent No.: US 11,732,442 B2
(45) Date of Patent: Aug. 22, 2023

(54) SYSTEM AND METHOD FOR CONTROLLING THE OPERATION OF A WORK VEHICLE TO PROVIDE IMPROVED RESPONSIVENESS WHEN COMMANDING IMPLEMENT MOVEMENT

(71) Applicant: CNH Industrial America LLC, New Holland, PA (US)

(72) Inventors: Duqiang Wu, Bolingbrook, IL (US); Navneet Gulati, Naperville, IL (US)

(73) Assignee: CNH Industrial America LLC, New Holland, PA (US)

( * ) Notice: Subject to any disclaimer, the term of this patent is extended or adjusted under 35 U.S.C. 154(b) by 716 days.

(21) Appl. No.: 16/690,267

(22) Filed: Nov. 21, 2019

(65) Prior Publication Data

US 2021/0156116 A1 May 27, 2021

(51) Int. Cl.

| | |
|---|---|
| ***E02F 9/22*** | (2006.01) |
| ***E02F 3/342*** | (2006.01) |
| ***E02F 9/26*** | (2006.01) |
| ***E02F 3/43*** | (2006.01) |

(52) U.S. Cl.

CPC ..... *E02F 9/2203* (2013.01); *E02F 3/342* (2013.01); *E02F 3/431* (2013.01); *E02F 9/221* (2013.01); *E02F 9/2228* (2013.01); *E02F 9/2235* (2013.01); *E02F 9/264* (2013.01)

(58) Field of Classification Search

CPC ..... E02F 9/221; E02F 9/2228; E02F 9/2235; E02F 3/405

See application file for complete search history.

(56) References Cited

U.S. PATENT DOCUMENTS

| | | | | |
|---|---|---|---|---|
| 4,055,255 | A | 10/1977 | Vasquez | |
| 5,235,809 | A * | 8/1993 | Farrell | E02F 9/221 60/494 |
| 5,860,231 | A | 1/1999 | Lee et al. | |
| 5,974,352 | A | 10/1999 | Shull | |
| 6,211,471 | B1 | 4/2001 | Rocke et al. | |
| 6,725,105 | B2 | 4/2004 | Francis et al. | |
| 6,879,899 | B2 | 4/2005 | Budde | |
| 7,114,747 | B2 | 10/2006 | Dix et al. | |
| 7,117,952 | B2 | 10/2006 | Bares et al. | |
| 7,571,604 | B2 | 8/2009 | Vigholm et al. | |

(Continued)

FOREIGN PATENT DOCUMENTS

GB 1575291 9/1980

*Primary Examiner* — Thomas E Lazo

(74) *Attorney, Agent, or Firm* — Rickard Demille; Rebecca Henkel

(57) ABSTRACT

A method for controlling the operation of a work vehicle includes initially controlling an operation of an implement actuator of the vehicle based on operator inputs received from an input device while a load sensing system of the vehicle is operable to adjust an output of an associated pump. The method also includes receiving an input providing an indication that an implement-based movement operation is to be performed and deactivating the load sensing system in response to the indication that the implement-based movement operation is to be performed. In addition, the method includes controlling the operation of the implement actuator based on further operator inputs received from the input device to perform the implement-based movement operation while the load sensing system is deactivated.

20 Claims, 4 Drawing Sheets

(56) References Cited

U.S. PATENT DOCUMENTS

| | | | | |
|---|---|---|---|---|
| 7,627,410 | B2 | 12/2009 | Berry et al. | |
| 7,726,125 | B2 * | 6/2010 | Brinkman | E02F 9/2296 60/452 |
| 7,866,149 | B2 | 1/2011 | Brinkman et al. | |
| 9,085,440 | B2 | 7/2015 | Choi | |
| 9,587,369 | B2 | 3/2017 | Fletcher et al. | |
| 9,850,639 | B2 | 12/2017 | Fletcher et al. | |
| 2005/0203691 | A1 | 9/2005 | Kim | |
| 2008/0010981 | A1 * | 1/2008 | Patel | E02F 9/221 60/381 |

* cited by examiner

SYSTEM AND METHOD FOR CONTROLLING THE OPERATION OF A WORK VEHICLE TO PROVIDE IMPROVED RESPONSIVENESS WHEN COMMANDING IMPLEMENT MOVEMENT

FIELD OF THE INVENTION

The present subject matter relates generally to work vehicles and, more particularly, to a system and method for controlling the operation of a work vehicle to provide improved responsiveness when commanding movement of an implement of the work vehicle, such as when the operator is commanding rapid movement of the implement to perform a shaking operation.

BACKGROUND OF THE INVENTION

Work vehicles having loader arms, such as wheel loaders, skid steer loaders, backhoe loaders, compact track loaders, and the like, are a mainstay of construction work and industry. For example, wheel loaders typically include a pair of loader arms pivotally coupled to the vehicle's chassis that can be raised and lowered at the operator's command. The loader arms typically have an implement attached to their end, thereby allowing the implement to be moved relative to the ground as the loader arms are raised and lowered. For example, a bucket is often coupled to the loader arms, which allows the wheel loader to be used to carry supplies or particulate matter, such as gravel, sand, or dirt, around a worksite. Typically, the bucket of a wheel loader is pivotally coupled to the loader arms to allow the implement to be pivoted or tilted relative to the loader arms across a plurality of positions. For instance, the bucket may be titled between a max curl position (e.g., at which the open portion of the bucket is facing upward) and a max dump position (e.g., at which the open portion of the bucket is facing downward).

During operation of a wheel loader or other work vehicle of similar construction, a need arises every so often to rapidly move the implement back and forth relative to the loader arms e.g., to shake the implement). For instance, an operator may desire to shake the implement to remove dirt, debris, or other materials that have accumulated or otherwise become stuck on the implement. To execute such implement shaking, the operator is required to move the control lever or joystick controlling the operation of the associated tilt cylinder back and forth quickly. However, the responsiveness of the vehicle's hydraulic system to such rapid movements of the control lever are often too slow or insufficient to provide the desired shaking of the implement. For instance, when the work vehicle is equipped with a load sensing system to adjust the output pressure/flow of the associated pump, the bandwidth of the hydraulic system is often relatively low. As a result, the operator may not be allowed to shake the implement in the manner required to achieve the desired operation.

Accordingly, a system and method for controlling the operation of a work vehicle in a manner that allows for desired responsiveness of an implement to operator-commanded movement (e.g., an operator-commanded shaking operation) would be welcomed in the technology.

BRIEF DESCRIPTION OF THE INVENTION

Aspects and advantages of the invention will be set forth in part in the following description, or may be obvious from the description, or may be learned through practice of the invention.

In one aspect, the present subject matter is directed to a method for controlling the operation of a work vehicle, wherein the work vehicle includes an implement actuator configured to control movement of an implement of the work vehicle and a pump configured to supply pressurized hydraulic fluid to the implement actuator. The method includes initially controlling, with a computing device, an operation of the implement actuator based on operator inputs received from an input device while a load sensing system of the work vehicle is operable to adjust an output of the pump. The method also includes receiving, with the computing device, an input providing an indication that an implement-based movement operation is to be performed, and deactivating, with the computing device, the load sensing system in response to the indication that the implement-based movement operation is to be performed. In addition, the method includes controlling, with the computing device, the operation of the implement actuator based on further operator inputs received from the input device to perform the implement-based movement operation while the load sensing system is deactivated.

In another aspect, the present subject matter is directed to a system for controlling the operation of a work vehicle. The system includes an implement and an implement actuator coupled to the implement, with the implement actuator configured to move the implement across a plurality of implement positions. The system also includes a pump configured to supply pressurized hydraulic fluid to the implement actuator, and a load sensing system configured to adjust an output of the pump based on a load pressure within a load sensing line of the load sensing system, with the load sensing system including a load bypass valve in fluid communication with the load sensing line. In addition, the system includes an input device configured to receive operator inputs for controlling the operation of the implement actuator based on a position of the input device, and a controller communicatively coupled to the input device and the load bypass valve. The controller is configured to: receive an input providing an indication that an implement-based movement operation is to be performed; control an operation of the load bypass valve to deactivate the load sensing system in response to the indication that the implement-based movement operation is to be performed; and control the operation of the implement actuator based on further operator inputs received from the input device to perform the implement movement operation while the load sensing system is deactivated.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
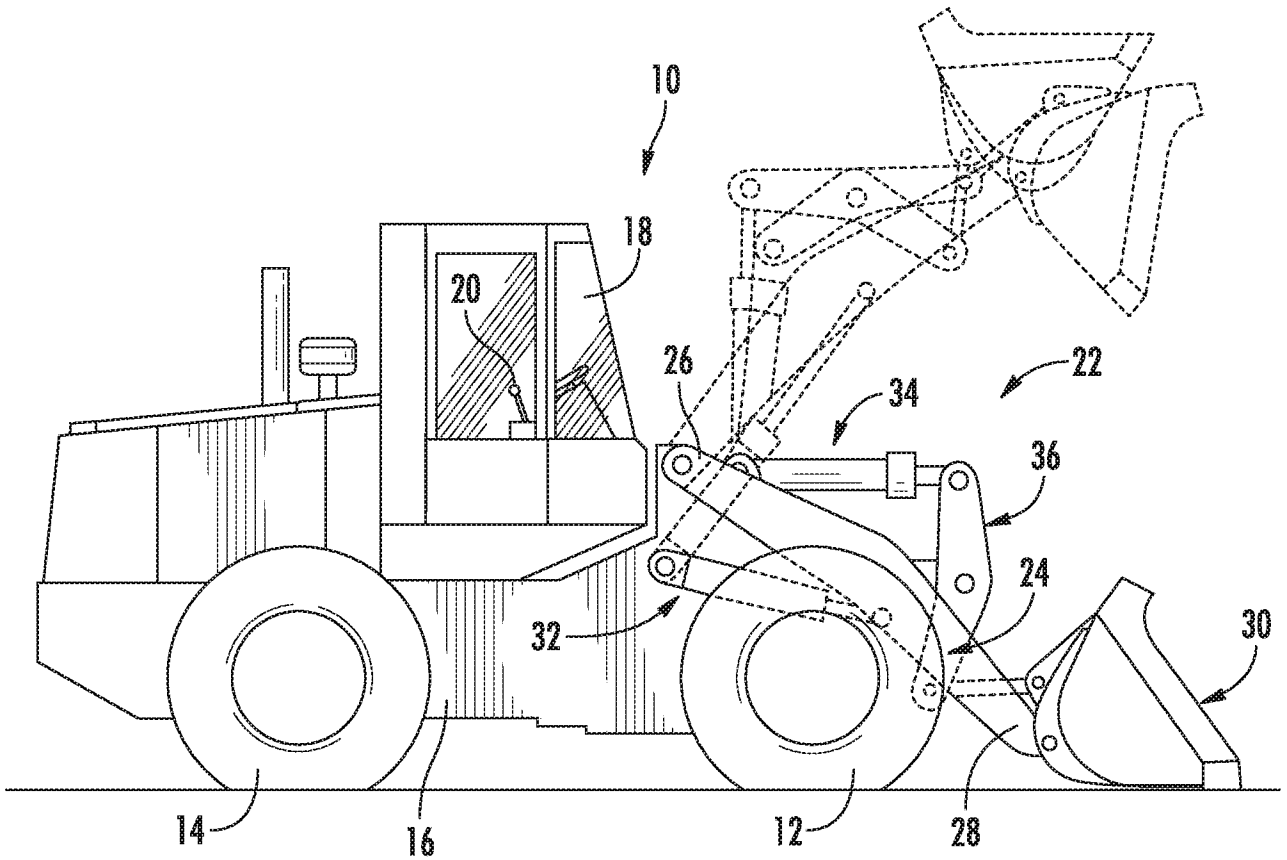
FIG. 1 illustrates a side view of one embodiment of a work vehicle in accordance with aspects of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

In general, the present subject matter is directed to systems and methods for controlling the operation of a work vehicle. Specifically, in several embodiments, the disclosed system and method may be used to improve the responsiveness of an implement of a work vehicle to rapid or quick movement commands, such as when controlling the movement of a bucket on a wheel loader in response to operator inputs received from a control lever that are associated with performing a bucket shaking operation.

In one implementation of the present subject matter, a controller of the disclosed system may be configured to receive an input providing an indication that an implement-based movement operation (e.g., a bucket shaking operation) is to be performed. Specifically, in one embodiment, the controller may be configured to monitor the movement of the control lever (e.g., via the operator inputs provided using the lever) to determine when the operator is attempting to perform an implement shaking operation. For instance, the controller may be configured to detect a pattern of control lever movements indicative of an implement shaking operation, such as when the control lever is moved back and forth quickly across a given range of positions. Upon detecting that the operator is attempting to perform an implement shaking operation, the controller may be configured to control one or more components of the vehicle's hydraulic system to shift the operation of the hydraulic system to a mode that provides the desired responsiveness for the commanded implement movement. Alternatively, the operator may be able to instruct the controller that an implement shaking operation is desired to be performed, such as by pressing a button on the control lever or by providing an input using any other suitable input device that provides an indication that an implement shaking operation is to be performed.

In accordance with aspects of the present subject matter, the controller may, in several embodiments, be configured to deactivate the vehicle's load sensing system when it is determined that the operator desires to perform or is performing an implement shaking operation, thereby transitioning the operation of the vehicle from a variable pump mode, in which the output of an associated pump of the hydraulic system is regulated via the load sensing system, to a static pump mode, in which the load sensing system is disabled and the output of the pump is set to a predetermined pump output (e.g., a maximum pressure and/or a maximum flow rate for the pump). Specifically, during normal operation of the hydraulic system, the pump output may be adjusted via operation of the load sensing system, thereby allowing the pump output to be adapted to the load demands on the hydraulic system to improve the overall operating efficiency of the system. For instance, when the load demands are low, the load sensing system may function to reduce the output pressure/flow of the pump. However, when the operator is attempting to perform an implement shaking operation, the load sensing system's bandwidth is typically insufficient to handle the high frequency pressure variations in the load sensing line as the operator is commands rapid back and forth movement of the implement. In such instance, with the load sensing system activated, the overall responsiveness of the implement to operator-commanded shaking may be undesirable. To address such issues, the present subject matter allows for the load sensing system to be temporarily deactivated or disabled when it is detected that the operator is attempting to perform an implement shaking operation. Deactivation of the load sensing system, in turn, results in the pump being operated in a static or fixed pump output mode in which the pump output is set to its high standby output parameters (e.g., the maximum output pressure/flow for the pump), thereby providing sufficient pressure/flow within the hydraulic system for accommodating rapid implement movements.

In several embodiments, the load sensing system includes an electronically controllable valve in fluid communication with the load sensing line. In such embodiments, the operation of the valve can be controlled to selectively deactivate the load sensing system. For instance, the valve may be normally positioned at an open or active position to allow the load sensing system to function normally. However, when it is desirable to deactivate the load sensing system, the valve may be actuated to a closed or return position to disconnect the load sensing line from the remainder of the load sensing system. For instance, when actuated to the closed or return position, the valve may connect the load sensing line to a pump outlet or supply line of the work vehicle. Once it is determined that the operator is no longer performing the implement shaking operation (e.g., via a series of logic detections, such as slow movements or shaking of the control lever, return of the control lever to the neutral position, the operator pressing a button to indicate that the operation is completed and/or the like), the valve may be returned to its open or active position to re-activate the load sensing system.

Referring now to the drawings, FIG. 1 illustrates a side view of one embodiment of a work vehicle 10. As shown, the work vehicle 10 is configured as a wheel loader. However, in other embodiments, the work vehicle 10 may be configured as any other suitable work vehicle known in the art, such as any other work vehicle including movable loader arms (e.g., any other type of front loader, such as skid steer loaders, backhoe loaders, compact track loaders and/or the like).

As shown in FIG. 1, the work vehicle 10 includes a pair of front wheels 12, a pair or rear wheels 14 and a chassis 16 coupled to and supported by the wheels 12, 14. An operator's cab 18 may be supported by a portion of the chassis 16 and may house various control or input devices (e.g., levers, pedals, control panels, buttons and/or the like) for permitting an operator to control the operation of the work vehicle 10.

For instance, as shown in FIG. 1, the work vehicle 10 may include one or more control levers 20 for controlling the operation of one or more components of a lift assembly 22 of the work vehicle 10.

As shown in FIG. 1, the lift assembly 22 may include a pair of loader arms 24 (one of which is shown) extending lengthwise between a first end 26 and a second end 28, with the first ends 26 of the loader arms 24 being pivotally coupled to the chassis 16 and the second ends 28 of the loader arms 24 being pivotally coupled to a suitable implement 30 of the work vehicle. (e.g., a bucket, fork, blade, and/or the like). In addition, the lift assembly 22 also includes a plurality of actuators for controlling the movement of the loader arms 24 and the implement 30. For instance, the lift assembly 22 may include a pair of hydraulic lift cylinders 32 (one of which is shown) coupled between the chassis 16 and the loader arms 24 for raising and lowering the loader arms 24 relative to the ground and a pair of hydraulic tilt cylinders 34 (one of which is shown) for tilting or pivoting the implement 30 relative to the loader arms 24 (e.g., between dump and curl positions). As shown in the illustrated embodiment, each tilt cylinder 34 may, for example, be coupled to the implement 30 via a linkage or lever arm 36. In such an embodiment, extension or retraction of the tilt cylinders 34 may result in the lever arm 36 pivoting about a given pivot point to tilt the implement 30 relative to the loader arms 24.

It should be appreciated that the configuration of the work vehicle 10 described above and shown in FIG. 1 is provided only to place the present subject matter in an exemplary field of use. Thus, it should be appreciated that the present subject matter may be readily adaptable to any manner of work vehicle configuration. For example, the work vehicle 10 was described above as including a pair of lift cylinders 32 and a pair of tilt cylinders 34. However, in other embodiments, the work vehicle 10 may, instead, include any number of lift cylinders 32 and/or tilt cylinders 24, such as by only including a single lift cylinder 32 for controlling the movement of the loader arms 24 and/or a single tilt cylinder 34 for controlling the movement of the implement 30.

Figure 2:
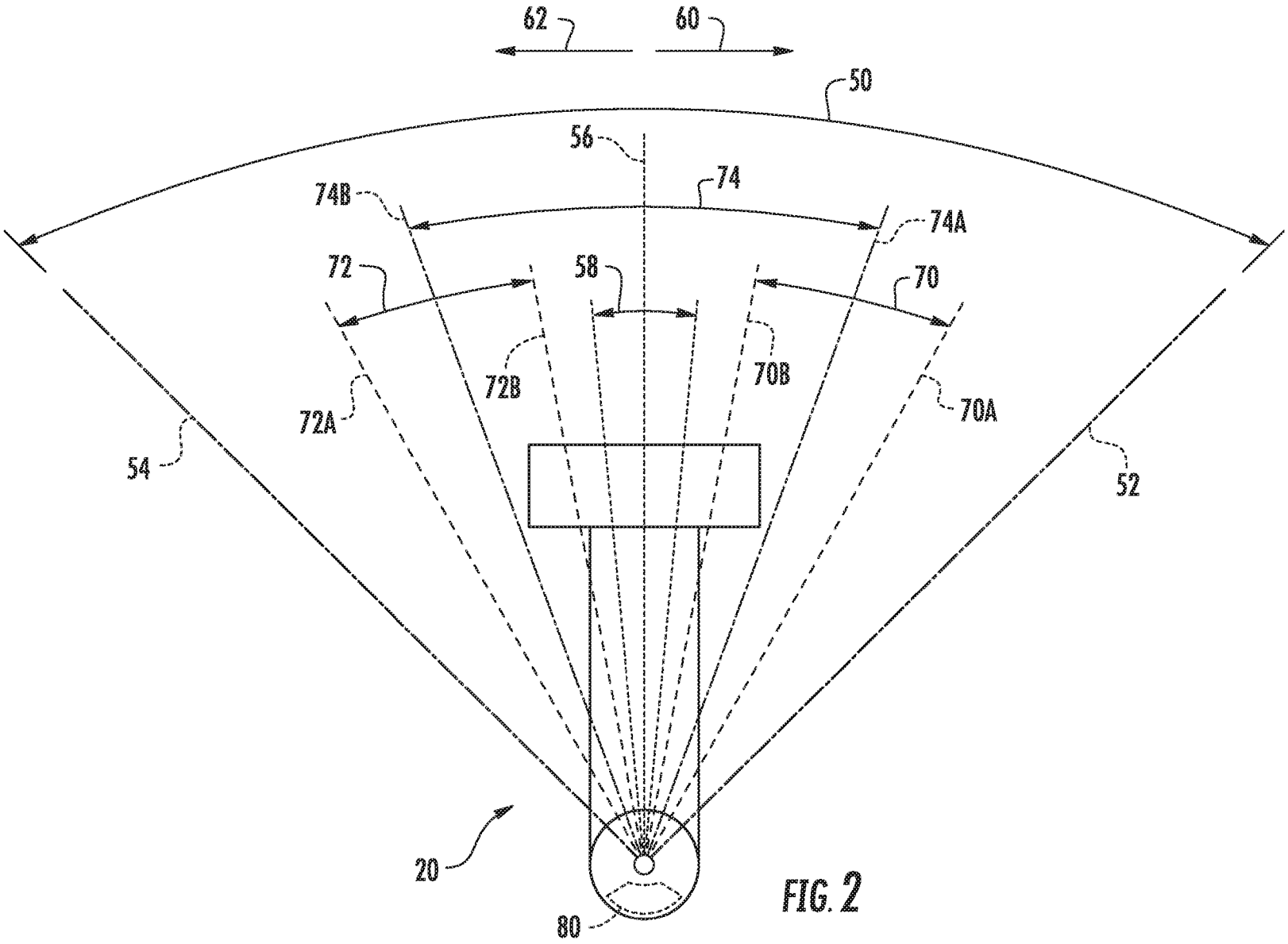
FIG. 2 illustrates a schematic view of one embodiment of an input device suitable for use with the work vehicle shown in FIG. 1, particularly illustrating exemplary movement ranges defined for the input device across its overall travel range.

Referring now to FIG. 2, a schematic view of one embodiment of an input device suitable for use with the work vehicle 10 described above with reference to FIG. 1 is illustrated in accordance with aspects of the present subject matter. Specifically, in the illustrated embodiment, the input device is configured as a control lever (e.g., lever 20 of FIG. 1), which, as used herein, generally refers to any suitable input device configured to be moved or pivoted across a range of positions (e.g., including joysticks and similar input devices). For purposes of the present disclosure, the control lever 20 will generally be described with reference to providing operator inputs for controlling the operation of the tilt cylinders 34, thereby allowing the operator to control the tilting or movement of the implement 30 relative to the loader arms 24. However, it should be appreciated that the control lever 20 may generally be configured to control any suitable component(s) of the work vehicle 10, such as the lift cylinders 32.

As shown, the control lever 20 has an overall travel range 50 including a plurality of lever positions defined between a first maximum position (indicated by line 52) and a second maximum position (indicated by line 54). Additionally, the travel range 50 for the control lever 20 may be centered or defined relative to a central lever position (indicated by line 56). In several embodiments, a neutral position range 58 for the control lever 20 may be defined relative to the center lever position 56. As is generally understood, the amount or range of lever positions included within the neutral position range 58 generally corresponds to the "neutral position" for the control lever 20 at which the control output is equal to zero or is otherwise associated with the operator not commanding movement of the implement 30. It should be appreciated that the specific range of lever positions included within the neutral position range 58 may generally vary depending on the lever configuration and/or the configuration of the associated hydraulic/control system. For instance, in one embodiment, the neutral position range 58 may span a given angular range of lever positions centered relative to the center lever position 56, such as a range of lever positions equal to about 1% to about 10% of the overall travel range 50 for the lever 20. Alternatively, the neutral position range 58 may only encompass the center lever position 56 such that the control lever 20 is only considered to be in "neutral" when disposed at the center lever position 56.

It should be appreciated that, in embodiments in which the control lever 20 is configured to control the operation of the tilt cylinder 34, movement of the control lever 20 from a position within the neutral position range 58 in a first direction (indicated by arrow 60 in FIG. 2 and also referred to herein as the "dumping direction") towards the first maximum position 52 may, for example, result in the flow rate of hydraulic fluid to one end of the tilt cylinders 34 being increased from a minimum flow towards a maximum flow according to an applicable transfer function correlating the lever position to the flow rate, thereby allowing the implement 30 to be tilted in a corresponding direction (e.g., towards a full dump position) at varying rates. Similarly, movement of the control lever 20 from a position within the neutral position range 58 in a second direction (indicated by arrow 62 in FIG. 2 and also referred to herein as the "curling direction") towards the second maximum position 54 may, for example, result in the flow rate of hydraulic fluid to the opposed end of the tilt cylinders 34 being increased from a minimum flow towards a maximum flow according to the applicable transfer function, thereby allowing the implement 30 to be tilted in an opposite direction (e.g., towards a fully curled position) at varying rates.

Additionally, as will be described in greater detail below, a controller of the disclosed system may be configured to monitor the position of the control lever 20 to identify when the operator is attempting to perform a specific implement-based operation. For instance, the controller may be configured to monitor the movement of the control lever 20 to detect when the operator has moved the lever 20 according to a predetermined or recognizable pattern indicative of an attempt to perform an implement shaking operation. Specifically, in several embodiments, the controller may be configured to monitor the lever movement and determine when the operator has moved the control lever back and forth across a given range of lever positions a threshold number of times (e.g., two or more times) within a given time period (e.g., a period of 1-2 seconds). The detection of this particular pattern of movements relative to the associated lever position range may then be interpreted by the controller as an indication that the operator is attempting to perform an implement shaking operation. As will be described below in more detail, upon determining that the operator is attempting to perform an implement shaking operation, the controller may be configured to adjust the operation of the vehicle's hydraulic system (e.g., by temporarily disabling the hydraulic load sensing system) to provide the desired performance based on the commanded implement movement.

In one embodiment, the controller may be configured to monitor the movement of the control lover 20 relative to one or more predetermined lever movement ranges to identify the operator's desire to perform an implement shaking operation. In such an embodiment, the controller may identify the operator's intent to perform an implement shaking operation when the control lever is moved rapidly back and forth across at least one of the predetermined lever movement ranges (e.g., across the range a threshold number of times within a given time period).

For instance, in the illustrated embodiment, four separate lever movement ranges have been defined across the travel range 50 of the control lever 20, namely the neutral position range 58, a first lever movement range 70, a second lever movement range 72, and a third lever movement range 74. Specifically, the first lever movement range 70 extends across a range of lever positions defined between the first maximum position 52 and the neutral position range 58, with such movement range 70 being bounded by a first max range position (indicated by line 70A) and a first min range position (indicated by line 70B). The second lever movement range 72 extends across a range of lever positions defined between the second maximum position 54 and the neutral position range 58, with such movement range 72 being bounded by a second max range position (indicated by line 72A) and a second min range position (indicated by line 72B). As a result, the first and second lever movement ranges 70, 72 correspond to non-overlapping lever position ranges and, thus, do not include any overlapping lever positions. Additionally, as shown in FIG. 2, the third lever movement range 74 extends across a range of lever positions defined between the first and second maximum positions 52, 54 that spans across the neutral position range 58, with such movement range 74 being bounded by a third max range position (indicated by line 74A) and a third min range position (indicated by line 74B). As shown in the illustrated embodiment, the third lever movement range 74 overlaps portions of the neutral position range 58 and the first and second movement ranges 70, 72.

It should be appreciated that the specific lever movement ranges 58, 70, 72, 74 shown in FIG. 2 are simply provided as examples of suitable sub-ranges or lever position subsets that can be defined across the travel range 50 of the control lever 20. In other embodiments, the pre-defined lever movement range(s) may span across or encompass any other range of lever positions included within the overall travel range 50. In addition, each lever movement range may be defined relative to the other movement ranges in any suitable manner, such as by selecting the lever movement ranges such that all of the ranges include overlapping lever positions or by selecting the lever movement ranges such that all of the ranges correspond to non-overlapping position ranges. It should also be appreciated that any other suitable number of individual lever movement ranges may be defined across the travel range 50 for the control lever 20, such as less than four lever movement ranges (e.g., two or three lever movement ranges) or greater than four lever movement ranges (e.g., five or more lever movement ranges).

Additionally, it should be appreciated that, in several embodiments, a suitable position sensor 80 may be provided in operative association with the control lever 20 to allow the position of the lever 20 to be tracked or monitored across its travel range 50 (and relative to the various lever movement ranges 58, 70, 72, 74). For instance, in one embodiment, a sensor 80 may be provided in operative association with the control lever 20 that detects the angular position of the lever 20 relative to a reference point, thereby allowing the position of the lever 20 across its travel range 50 to be accurately monitored as the lever 20 is being manipulated by the operator.

Figure 3:
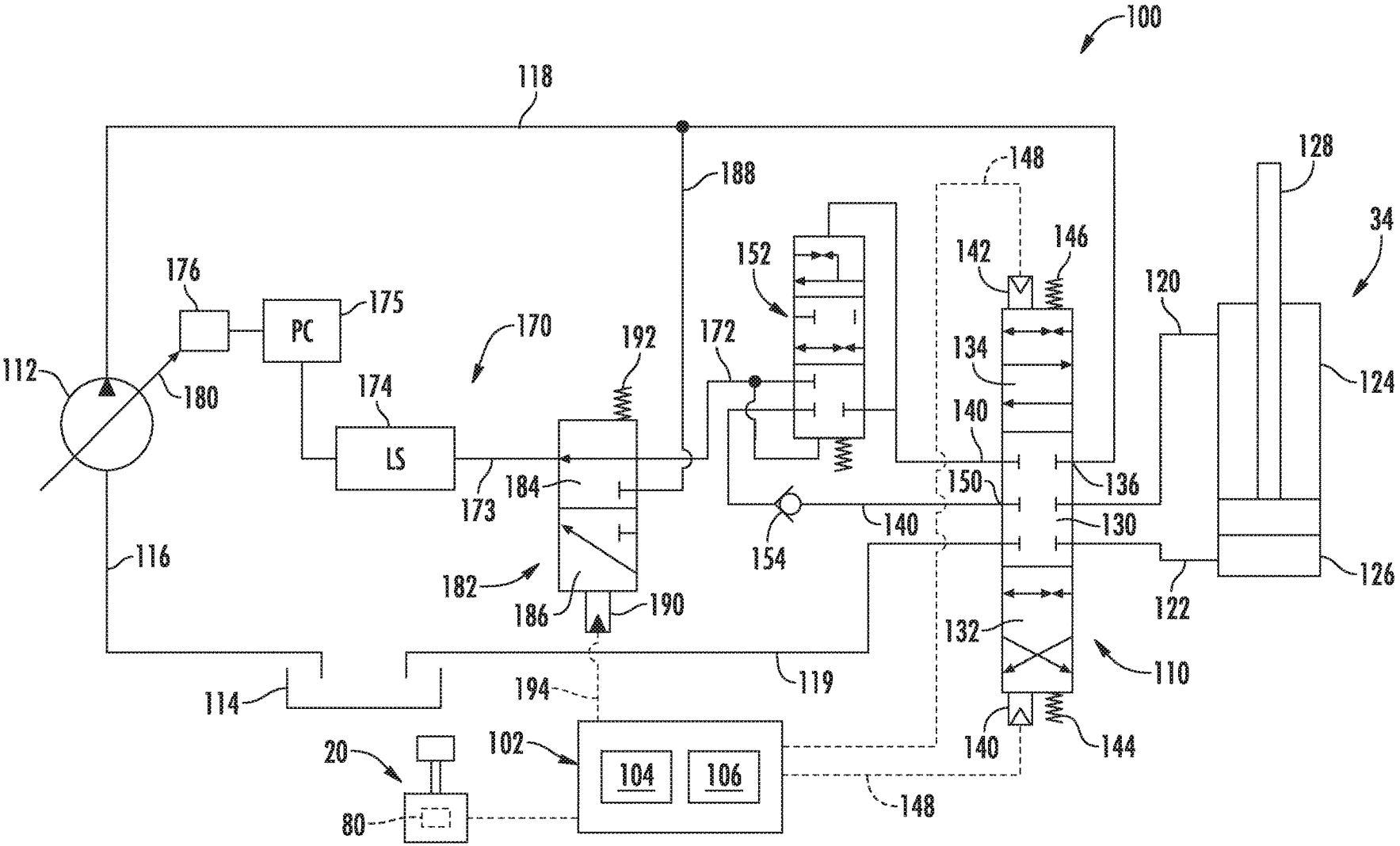
FIG. 3 illustrates a schematic diagram of one embodiment of a system for controlling the operation of a work vehicle in accordance with aspects of the present subject matter.

Referring now to FIG. 3, a schematic diagram of one embodiment of a system 100 for controlling the operation of a work vehicle is illustrated in accordance with aspects of the present subject matter. For purposes of discussion, the system 100 will be described herein with reference to the work vehicle 10 shown and described above with reference to FIG. 1. However, it should be appreciated that, in general, the disclosed system 100 may be utilized to control the operation of any work vehicle having any suitable vehicle configuration. It should also be appreciated that, for purposes of illustration, hydraulic connections between components of the system 100 are shown in solid lines while electrical connection between components of the system 100 are shown in dashed lines.

As shown, the system 100 may generally include a controller 102 configured to electronically control the operation of one or more components of the work vehicle 10, such as the various hydraulic components of the work vehicle 10. In general, the controller 102 may comprise any suitable processor-based device known in the art, such as a computing device or any suitable combination of computing devices. Thus, in several embodiments, the controller 102 may include one or more processor(s) 104 and associated memory device(s) 106 configured to perform a variety of computer-implemented functions. As used herein, the term "processor" refers not only to integrated circuits referred to in the art as being included in a computer, but also refers to a controller, a microcontroller, a microcomputer, a programmable logic controller (PLC), an application specific integrated circuit, and other programmable circuits. Additionally, the memory device(s) 106 of the controller 102 may generally comprise memory element(s) including, but not limited to, computer readable medium (e.g., random access memory (RAM)), computer readable non-volatile medium (e.g., a flash memory), a floppy disk, a compact disc-read only memory (CD-ROM), a magneto-optical disk (MOD), a digital versatile disc (DVD) and/or other suitable memory elements. Such memory device(s) 106 may generally be configured to store suitable computer-readable instructions that, when implemented by the processor(s) 104, configure the controller 102 to perform various computer-implemented functions, such as by performing one or more aspects of the method 200 described below with reference to FIG. 4. In addition, the controller 102 may also include various other suitable components, such as a communications circuit or module, one or more input/output channels, a data/control bus and/or the like.

It should be appreciated that the controller 102 may correspond to an existing controller of the work vehicle 10 or the controller 102 may correspond to a separate processing device. For instance, in one embodiment, the controller 102 may form all or part of a separate plug-in module that may be installed within the work vehicle 10 to allow for the disclosed system and method to be implemented without requiring additional software to be uploaded onto existing control devices of the vehicle 10.

Additionally, in several embodiments, the system 100 may include various components of the vehicle's hydraulic system for regulating the supply of hydraulic fluid to the tilt cylinder 34 (only one of which is shown), thereby allowing the movement of the implement 30 to be controlled. For instance, as shown in FIG. 3, the system 100 may include a control valve 110 configured to regulate the supply of hydraulic fluid between a pressurized fluid source, such as a pump 112, and the tilt cylinders 34. Specifically, the pump 112 may be in fluid communication with both a fluid tank or reservoir 114 (via pump line 116) and the control valve 110 (e.g., via supply line 118) to allow hydraulic fluid stored within the fluid tank 114 to be pressurized and supplied to the control valve 110. The control valve 110 is also in fluid communication with the fluid tank 114 (e.g., via a return line 119) to allow hydraulic fluid to be returned back to the tank 114. Additionally, as shown in FIG. 3, first and second actuator lines 120, 122 may be provided to fluidly couple the control valve 110 to the tilt cylinder 34, thereby allowing pressurized hydraulic fluid to be transferred between the control valve 110 and the tilt cylinder 34. Specifically, a first actuator line 120 may be fluidly coupled to a rod end 124 (e.g., a first end) of the tilt cylinder 34 and a second actuator line 112 may be fluidly coupled to a cap end 126 (e.g., a second end) of the tilt cylinder 34. As is generally understood, providing fluid to the cap end 126 of the tilt cylinder 34 may drive a piston rod 128 of the cylinder 34 to extend, and providing fluid to the rod end 126 of the tilt cylinder 34 may drive the piston rod 128 to retract. In one embodiment, extension of the piston rod 128 may move the implement 30 towards its full curl position while retraction of the piston rod 128 may move the implement 20 towards its full dump position.

In several embodiments, the pump 112 may be configured as variable displacement pump configured to supply a source pressure across a given pressure range. For example, the pump 112 may supply pressurized hydraulic fluid within a range bounded by a minimum source pressure and a maximum source pressure capability of the variable displacement pump. However, in other embodiments, the pump 112 may correspond to any other suitable pressurized fluid source.

As shown in the illustrated embodiment, the control valve 110 is configured as a pass-through three-position/four-way valve. In such an embodiment, the control valve 110 may include a neutral or first position 130 corresponding to a closed position at which fluid flow between the supply/return lines 118/119 and the first and second actuator lines 120, 122 is blocked or cut-off. A second position 132 of the control valve 110 may be configured to facilitate fluid flow between the supply line 118 and the cap end 126 of the tilt cylinder 34 (e.g., via the second actuator line 122) and between the return line 119 and the rod end 124 of the tilt cylinder 34 (e.g., via the first actuator line 120) to extend the tilt cylinder(s 34. A third position 134 of the control valve 110 may be configured to facilitate fluid flow between the supply line 118 and the rod end 124 of the tilt cylinder 34 and between the return line 119 and the cap end 126 of the tilt cylinder 34 to retract the tilt cylinder 34. In the illustrated embodiment, the control valve 110 includes a pass-through port 136 that fluidly couples the supply line 118 to an intermediate supply line 140 when the control valve 110 is located at the second and third positions 132, 134.

In the illustrated embodiment, the control valve 110 also includes a first actuator 140 configured to drive the control valve 110 to the second position 132 and a second actuator 142 configured to drive the control valve 110 to the third position 134. In the illustrated embodiment, the first and second actuators 140, 142 correspond to electronically-controlled actuators (e.g., solenoid actuators) configured to move the control valve 110 in response to receiving an electric signal from the controller 102 (e.g., via electrical connections 148 provided between the controller 102 and each actuator 140, 142). In addition, the control valve 110 may include biasing elements 144, 146 (e.g., springs) configured to urge the control valve 110 toward the first position 130. Accordingly, the controller 102 may be configured to apply an electric current to the first actuator 140 to drive the control valve 110 to the second position 132 against the bias of the associated biasing element 144, and also apply an electric current to the second actuator 142 to drive the control valve 110 to the third position 134 against the bias of the associating biasing element 46. Similarly, if no electric current is applied to either actuator 140, 142, the biasing elements 144, 146 may drive the control valve 110 to the first position 130, thereby blocking fluid flow between the supply and return lines 118, 119 and the tilt cylinder 34.

As shown in FIG. 3, the intermediate supply line 140 fluidly couples the pass-through port 136 of the control valve 110 to an inlet port 150 of the control valve 110. In several embodiments, one or more auxiliary or secondary valves may be provided in-line or otherwise in fluid communication with the intermediate supply line 140. For instance, in the illustrated embodiment, a valve 152 (e.g., a pilot-operated proportional valve) is provided in-line with the intermediate supply line 140 to regulate the pressure of the hydraulic fluid supplied to the inlet port 150 of the control valve 110. In one embodiment, the valve 152 may be configured as a load sensing valve, such as a pre-compensation or post-compensation valve, that is configured to supply the highest load through the intermediate supply line 140 to the inlet port 140. Additionally, as shown in FIG. 3, a check valve 154 is provided in-line with the intermediate supply line 140 at a location downstream of the valve 152 (and upstream of the inlet port 150) to prevent back-flow from the inlet port 150.

Moreover, in accordance with aspects of the present subject matter, the system 100 may also include a hydraulic load sensing system or sub-system 170 for adjusting the output of the pump 112 based on the hydraulic load applied through the vehicle's hydraulic system. Specifically, in the illustrated embodiment, the load sensing system 170 includes a load sensing line 172 in fluid communication with the valve 152 such that a portion of the pressurized hydraulic fluid flowing through the valve 152 is diverted through the load sensing line 172. The pressurized hydraulic fluid diverted through the load sensing line 172 may then be directed through a load sensing circuit 174 of the load sensing system 170, with the load sensing circuit 174 configured to allow the highest load or pressure within the circuit 174 to be delivered to a pump compensator 176 for adjusting the output of the pump 112 (e.g., the output pressure or flow rate of the pump 112). For instance, the load sensing circuit 174 may be coupled to various hydraulic loads in addition to the tilt cylinder 34 (e.g., via a load sensing circuit line 173), such as the lift cylinders 32 and any other suitable components of the vehicle's hydraulic system. By allowing the highest load or pressure of the various loads connected to the load sensing circuit 174 to be delivered to the pump compensator 176, the pump operation may be adjusted, as necessary, such that the source pressure of the pump 112 matches the highest pressure connected to the load sensing circuit 174, thereby ensuring that sufficient source pressure is delivered for meeting the current demands of the hydraulic system while conserving energy by preventing an excessive pump output. As shown in FIG. 3, a pump compensating circuit 175 may also be provided upstream of the pump compensator 176.

It should be appreciated that, in one embodiment, the pump compensator 176 may correspond to a passive device. For instance, the pump compensator 176 may correspond to a passive hydraulic cylinder coupled to the swash plate of the pump 112 (e.g., indicated by arrow 180). In such an embodiment, the load pressure delivered to the pump compensator 176 from the load sensing circuit 174 may serve to adjust the degree of extension/retraction of the hydraulic cylinder, thereby varying the position of the swash plate 180 and, thus, the pump output. Alternatively, the pump compensator 176 may correspond to an active device. For instance, the pump compensator 176 may include a pressure sensor configured to detect the load pressure supplied from the load sensing circuit 176 and a swash plate actuator configured to be actively controlled based on the sensed pressure to adjust the swash plate position, as necessary, to ensure that the source pressure of the pump 112 matches the load pressure from the load sensing circuit 174.

Additionally, in accordance with aspects of the present subject matter, a load bypass valve 182 may be provided in fluid communication with the load sensing line 172 to allow the load sensing circuit 174 to be selectively connected to the pump supply line 118 when desired, thereby disabling the load sensing system 170. Specifically, as shown in FIG. 3, the load bypass valve 182 is provided between the load sensing line 172 and the load sensing circuit line 173 fluidly coupling the valve 182 to the load sensing circuit 174. In the illustrated embodiment, the load bypass valve 182 corresponds to a two-position/three way valve. For example, the load bypass valve 182 includes an open/activated or first position 184 at which the load sensing circuit 174 of the load sensing system 170 is in fluid communication with the supply of fluid directed through the valve 152, thereby allowing the pressurized fluid diverted through the load sensing line 172 to be directed to the load sensing circuit 174 (e.g., via the load sensing circuit line 173). Additionally, the load bypass valve 182 includes a closed/deactivated or second position 186 at which the supply of pressured fluid to the load sensing circuit 174 from the load sensing line 172 is cut-off and the load sensing circuit line 173 is, instead, connected to the pump supply line 118 (e.g., via pump connector line 188). As such, when the load bypass valve 182 is disposed at its first or open/activated position 184, the load sensing system 110 may function normally, with pressurized fluid flowing through the load sensing circuit line 173 to the load sensing circuit 174 to allow the pump operation to be adjusted based on the highest load pressure within the circuit 174. However, when the load bypass valve 182 is moved to its second or closed/deactivated position 186, the load sensing system 170 is disabled or deactivated. In such instance, the pump 112 is configured to provide pressurized fluid through the circuit at a predetermined pump output, such as at a maximum pressure/flow output for the pump 112). Specifically, by connecting the load sensing circuit line 173 to the pump supply line 118, a high load sense signal is transmitted through the load sensing circuit line 173 that is equal to the pump output pressure, thereby indicating that a high standby pressure is required from the pump. This high load sense signal effectively disables the load sensing circuit 174, thereby causing the pump compensation circuit 175 to drive the pump output pressure up to the high standby pressure.

As shown in the illustrated embodiment, the load bypass valve 182 is configured as a solenoid-activated valve. As a result, the load bypass valve 182 includes an electronically controlled actuator 190 configured to be automatically controlled by the controller 102 (e.g., via electric signals provided through communicative link 194) to actuate the valve 182 to its second or closed/deactivated position 186. In addition, as shown in FIG. 3, the load bypass valve 182 includes a biasing element 192 (e.g., a spring) configured to bias the valve 182 towards its first or opened/activated position 184. In such an embodiment, when it is desired to deactivate the load sensing system 170, the controller 102 may be configured to transmit a suitable electric signal to the actuator 190 to cause the load bypass valve 182 to be actuated to its second or closed/deactivated position 186.

Referring still to FIG. 3, the disclosed system 100 may also include one or more input devices communicatively coupled to the controller 102 for providing operator inputs to the controller 102. Such input device(s) may generally correspond to any suitable input device(s) or human-machine interface(s) (e.g., a control panel, one or more buttons, levers, and/or the like) housed within the operator's cab 18 that allows for operator inputs to be provided to the controller 102. For example, in a particular embodiment, the input device(s) may include one or more control levers (e.g., the control lever 20 described above with reference to FIG. 2) that allow the operator to transmit suitable operator inputs for controlling the various hydraulic components of the work vehicle 10, such as the tilt cylinder(s) 34, thereby permitting the operator to control the position and/or movement of the implement 30. For instance, as described above with reference to FIG. 2, the operator may be allowed to move the control lever 20 forward or backward across its travel range 50 to indicate his/her desire to pivot or tilt the implement 30 relative to the loader arms 24 in one direction or the other (e.g., in a dumping direction or a curling direction). In addition, a separate input device may be provided to allow the operator to indicate his/her desire to perform a specific implement-based movement operation, such as an implement shaking operation.

Moreover, the controller 102 may also be communicatively coupled to one or more sensors for monitoring one or more operating parameters of the work vehicle 10. For instance, as shown in FIG. 3, the controller 102 may be coupled to one or more position sensors 80 for monitoring the position of the control lever 20. As such, the controller 102 may track the position of the control lever 20 as it is being manipulated by the operator. Such lever position tracking may allow the controller, in turn, to estimate or infer when the operator is attempting to perform a specific implement-based operation, such as an implement shaking operation.

For instance, as described above with reference to FIG. 2, the controller 102 may be configured to track movements of the control lever 20 relative to one or more pre-defined lever movement ranges to determine when the operator is actuating the control lever 20 across or relative to a given movement range. Specifically, in several embodiments, the controller 102 may be configured to monitor the movement of the control lever 20 relative to the pre-defined lever movement range(s) to determine when the operator has moved the control lever 20 across or relative to the lever movement range(s) according to a pre-defined implement shaking pattern (e.g., movement back and forth across the lever movement range a threshold number of times within a given time period), thereby providing an indication that the operator is attempting to perform an implement shaking operation. When such a determination is made, the controller 102 may be configured to control the operation of the load bypass actuator 190 to actuate the associated valve 182 to its closed or deactivated position 186, thereby disabling or deactivating the load sensing system 170. In doing so, the pump 112 may default to its predefined standby output pressure/flow (e.g., its maximum output pressure/flow), thereby allowing a sufficient pressure/flow to be supplied through the hydraulic system to facilitate desired responsiveness of the implement movement during the shaking operation.

Additionally, upon deactivating the load sensing system 170, the controller 102 may be configured to continue to track the movement of the control lever 20 to determine when the implement shaking operation has been completed. For instance, in one embodiment, the controller may be configured to continue to track the movements of the control lever 20 relative to the associated lever movement range(s) to determine when the operator ceases or stops moving the control lever 20 across or relative to the lever movement range(s) according to the pre-defined implement shaking pattern (e.g., the control lever 20 is no longer being moved across the lever movement range the threshold number of times within the given time period). Once it is determined that the operator is no longer commanding the performance of the implement shaking operation, the controller may be configured to re-activate the load sensing system 170 to allow the pump output to again be regulated via operation of the load sensing system 170. For instance, the controller 102 may be configured to deactivate the load bypass actuator 190 to allow the associated biasing element 192 to bias the load bypass valve 182 back to its open or activated position 184, thereby re-activating the load sensing system 170

Figure 4:
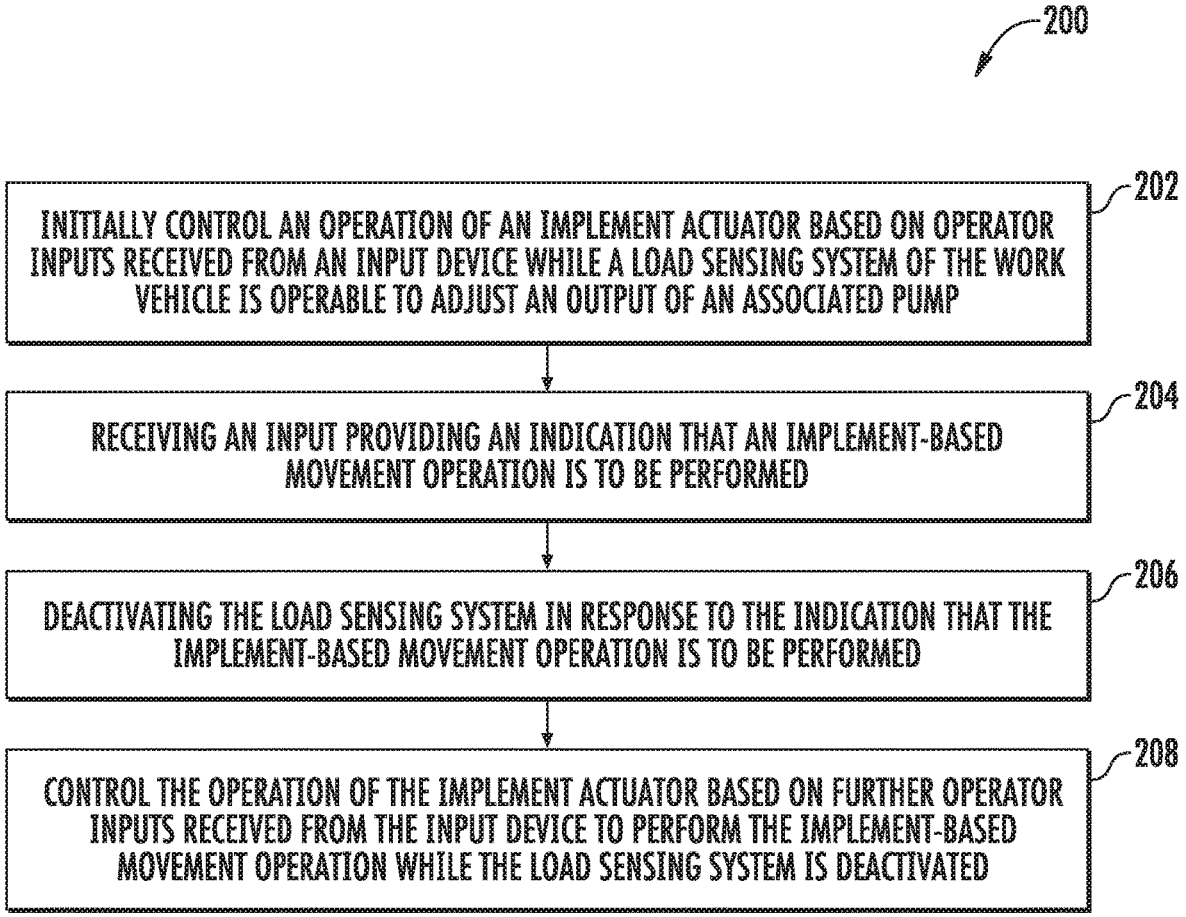
FIG. 4 illustrates a flow diagram of one embodiment of a method for controlling the operation of a work vehicle in accordance with aspects of the present subject matter.

Referring now to FIG. 4, a flow diagram of one embodiment of a method 200 for controlling the operation of a work vehicle is illustrated in accordance with aspects of the present subject matter. In general, the method 200 will be described herein with reference to the system 100 described above with reference to FIG. 3. However, it should be appreciated by those of ordinary skill in the art that the disclosed method 200 may be implemented within any other system having any other suitable system configuration. In addition, although FIG. 4 depicts steps performed in a particular order for purposes of illustration and discussion, the methods discussed herein are not limited to any particular order or arrangement. One skilled in the art, using the disclosures provided herein, will appreciate that various steps of the methods disclosed herein can be omitted, rearranged, combined, and/or adapted in various ways without deviating from the scope of the present disclosure.

As shown in FIG. 4, at (202), the method 200 may include initially controlling an operation of an implement actuator based on operator inputs received from an input device while a load sensing system of the work vehicle is operable to adjust an output of an associated pump. Specifically, as indicated above, when operating within a normal or typical operational mode, the operation of the tilt cylinders 34 (and, thus, the movement of the implement 30) may be controlled by the controller 102 based on the operator-controlled position of the control lever 20 while the load sensing system 170 function to adjust the output of the pump 112 based on the load pressure supplied through the load sensing circuit 174.

Additionally, at (204), the method 200 may include receiving an input providing an indication that an implement-based movement operation is to be performed. Specifically, as indicated above, the controller 102 may, in one embodiment, be configured to monitor the movement of the control lever 20 relative to one or more predetermined lever movement ranges to detect a pattern of movement indicative of a desired implement-based movement operation. For instance, the controller 102 may be configured to determine that the operator is attempting to perform an implement shaking operation when it detects that the control lever 20 is being moved rapidly back and forth across a given lever movement range(s) (e.g., movement back and forth across the lever movement range a threshold number of times within a given time period). Alternatively, the controller may be configured to determine that the operator desired to perform a specific implement-based movement operation based on any other suitable inputs, such as when the operator presses a button or uses any other suitable input device to provide a direct indication that a given implement-based movement operation is about to be performed.

Moreover, at (206), the method 200 includes deactivating the load sensing system in response to the indication that the implement-based movement operation is to be performed. For example, as indicated above, by monitoring the movement of the control lever 20, the controller 102 may be configured to detect when the operator moves the lever 20 according to a predetermined pattern of lever movements, thereby indicating that the operator is attempting to perform a given implement-based movement operation. Upon detection of such pattern of lever movements, the controller may be configured to deactivate the load sensing system 170. For instance, as indicated above, the controller 102 may be configured to control the operation of the load bypass actuator 190 to actuate the associated load bypass valve 182 to its closed or deactivated position 186, thereby disabling or deactivating the load sensing system 170.

Referring still to FIG. 4, at (208), the method 200 includes controlling the operation of the implement actuator based on further operator inputs received from the input device to perform the implement-based movement operation while the load sensing system is deactivated. Specifically, as indicated above, upon deactivation of the load sensing system 170, the pump 112 may default to its predefined standby output pressure/flow (e.g., its maximum output pressure/flow), thereby allowing a sufficient pressure/flow to be supplied through the hydraulic system to facilitate desired responsiveness of the implement movement during the operation being performed. Thus, when the operator is attempting to perform an implement shaking operation, the standby output pressure/flow of the pump 112 may allow the operation of the tilt cylinders 34 to be controlled in response to operator inputs in a manner that provides improved or enhanced responsiveness (e.g., as comparted to when the load sensing system 170 is still active).

It is to be understood that the steps of the method 200 are performed by the controller 102 upon loading and executing software code or instructions which are tangibly stored on a tangible computer readable medium, such as on a magnetic medium, e.g., a computer hard drive, an optical medium, e.g., an optical disc, solid-state memory, e.g., flash memory, or other storage media known in the art. Thus, any of the functionality performed by the controller 102 described herein, such as the method 200, is implemented in software code or instructions which are tangibly stored on a tangible computer readable medium. The controller 102 loads the software code or instructions via a direct interface with the computer readable medium or via a wired and/or wireless network. Upon loading and executing such software code or instructions by the controller 102, the controller 102 may perform any of the functionality of the controller 102 described herein, including any steps of the method 200 described herein.

The term "software code" or "code" used herein refers to any instructions or set of instructions that influence the operation of a computer or controller. They may exist in a computer-executable form, such as machine code, which is the set of instructions and data directly executed by a computer's central processing unit or by a controller, a human-understandable form, such as source code, which may be compiled in order to be executed by a computer's central processing unit or by a controller, or an intermediate form, such as object code, which is produced by a compiler. As used herein, the term "software code" or "code" also includes any human-understandable computer instructions or set of instructions, e.g., a script, that may be executed on the fly with the aid of an interpreter executed by a computer's central processing unit or by a controller.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method for controlling the operation of a work vehicle, the work vehicle including an implement actuator configured to control movement of an implement of the work vehicle and a pump configured to supply pressurized hydraulic fluid to the implement actuator, the method comprising:

initially controlling, with a computing device, an operation of the implement actuator based on operator inputs received from an input device while a load sensing system of the work vehicle is operable to adjust an output of the pump;

receiving, with the computing device, an input providing an indication that an implement-based movement operation is to be performed;

deactivating, with the computing device, the load sensing system in response to the indication that the implement-based movement operation is to be performed;

setting, with the computing device, the output of the pump to a maximum pump output when the load sensing system is deactivated; and controlling, with the computing device, the operation of the implement actuator based on further operator inputs received from the input device to perform the implement-based movement operation while the load sensing system is deactivated and while the pump output is supplying pressurized hydraulic fluid at the maximum pump output.

2. The method of claim 1, wherein receiving the input providing the indication that the implement-based movement operation is to be performed comprises monitoring movement of the input device to detect a pattern of input device movements indicative of an implement-based movement operation, and wherein deactivating the load sensing system comprises deactivating the load sensing system in response to the detection of the pattern of input device movements.

3. The method of claim 2, wherein the input device is movable across a range of positions, wherein monitoring the movement of the input device comprises monitoring the movement of the input device relative to a movement range defined across a portion of the range of positions to detect the pattern of input device movements.

4. The method of claim 3, wherein monitoring the movement of the input device relative to the movement range comprises detecting when the input device is moved across the movement range a threshold number of times within a given time period.

5. The method of claim 2, further comprising:

further monitoring, with the computing device, the movement of the input device to determine when the implement-based movement operation is no longer being performed; and upon the determination that the implement-based movement operation is no longer being performed, re-activating the load sensing system to allow the output of the pump to be regulated by the load sensing system.

6. The method of claim 1, wherein the implement-based movement operation comprises an implement shaking operation.

7. The method of claim 1, wherein a load bypass valve is provided in fluid communication with a load sensing line of the load sensing system, wherein deactivating the load sensing system comprises controlling an operation of the load bypass valve to deactivate the load sensing system.

8. The method of claim 7, wherein controlling the operation of the load bypass valve comprises actuating the load bypass valve to a position at which the load sensing line is connected to a pump supply line of the work vehicle.

9. The method of claim 1, wherein controlling the operation of the implement actuator comprises controlling an operation of a control valve configured to regulate the supply of pressurized hydraulic fluid to the implement actuator.

10. The method of claim 1, wherein the implement actuator comprises a tilt cylinder configured to adjust a tilt angle of the implement.

11. The method of claim 1, wherein the maximum pump output comprises at least one of a maximum pressure or a maximum flow rate for the pump.

12. A system for controlling the operation of a work vehicle, the system comprising:

an implement;

an implement actuator coupled to the implement, the implement actuator configured to move the implement across a plurality of implement positions;

a pump configured to supply pressurized hydraulic fluid to the implement actuator;

a load sensing system configured to adjust an output of the pump based on a load pressure within a load sensing line of the load sensing system, the load sensing system including a load bypass valve in fluid communication with the load sensing line;

an input device configured to receive operator inputs for controlling the operation of the implement actuator based on a position of the input device; and a controller communicatively coupled to the input device and the load bypass valve, the controller being configured to:

receive an input providing an indication that an implement-based movement operation is to be performed;

control an operation of the load bypass valve to deactivate the load sensing system in response to the indication that implement-based movement operation is to be performed;

set the output of the pump to a maximum pump output when the load sensing system is deactivated; and control the operation of the implement actuator based on further operator inputs received from the input device to perform the implement movement operation while the load sensing system is deactivated and while the pump output is supplying pressurized hydraulic fluid at the maximum pump output.

13. The system of claim 12, wherein the controller is configured to monitor movement of the input device to detect a pattern of input device movements indicative of the implement-based movement operation and control the operation of the load bypass valve to deactivate the load sensing system in response to the detection of the pattern of input device movements.

14. The system of claim 13, wherein the input device is movable across a range of positions, wherein the controller is configured to monitor the movement of the input device relative to a movement range defined across a portion of the range of positions to detect the pattern of input device movements.

15. The system of claim 14, wherein the controller detects the pattern of input device movements when the input device is moved across the movement range a threshold number of times within a given time period.

16. The system of claim 13, wherein the controller is further configured to:

further monitor the movement of the input device to determine when the implement-based movement operation is no longer being performed; and upon the determination that the implement-based movement operation is no longer being performed, re-activate the load sensing system to allow the output of the pump to be regulated by the load sensing system.

17. The system of claim 12, wherein the implement-based movement operation comprises an implement shaking operation.

18. The system of claim 12, wherein controller is configured to actuate the load bypass valve to a position at which the load sensing line is connected to a pump supply line to deactivate the load sensing system, the pump being configured to supply the pressurized hydraulic fluid through the pump supply line.

19. The system of claim 12, wherein the controller is configured to control the operation of the implement actuator by controlling an operation of a control valve configured to regulate the supply of pressurized hydraulic fluid to the implement actuator.

20. The system of claim 12, wherein the maximum pump output comprises at least one of a maximum pressure or a maximum flow rate for the pump.

* * * * *